US009381555B2

(12) United States Patent
Miyahara

(10) Patent No.: US 9,381,555 B2
(45) Date of Patent: Jul. 5, 2016

(54) METHOD OF COLD ROLLING A SEAMLESS PIPE

(71) Applicant: NIPPON STEEL & SUMITOMO METAL CORPORATION, Tokyo (JP)

(72) Inventor: Osamu Miyahara, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 71 days.

(21) Appl. No.: 14/391,808

(22) PCT Filed: Apr. 5, 2013

(86) PCT No.: PCT/JP2013/002357
§ 371 (c)(1),
(2) Date: Oct. 10, 2014

(87) PCT Pub. No.: WO2013/153794
PCT Pub. Date: Oct. 17, 2013

(65) Prior Publication Data

US 2015/0101381 A1 Apr. 16, 2015

(30) Foreign Application Priority Data

Apr. 12, 2012 (JP) ..... 2012-090947

(51) Int. Cl.
*B21B 21/00* (2006.01)
*B21B 23/00* (2006.01)

(52) U.S. Cl.
CPC ..... *B21B 21/00* (2013.01); *B21B 23/00* (2013.01); *B21B 2261/04* (2013.01); *B21B 2263/20* (2013.01)

(58) Field of Classification Search
CPC ..... E21B 21/00; E21B 23/00; E21B 2261/04; B21C 37/06
USPC ..... 72/199
See application file for complete search history.

(56) References Cited

U.S. PATENT DOCUMENTS 2,480,011 A * 8/1949 Freter ..... B21C 37/29 29/890.14
3,779,446 A * 12/1973 Lemelson ..... B23K 5/08 228/15.1
5,946,365 A * 8/1999 Drillon ..... B21B 21/005 376/260
6,196,039 B1 * 3/2001 Williams ..... B21D 17/04 72/105

FOREIGN PATENT DOCUMENTS

JP 2006-346726 12/2006
JP 2009-006384 1/2009

* cited by examiner

*Primary Examiner* — David B Jones
(74) *Attorney, Agent, or Firm* — Clark & Brody

(57) ABSTRACT

In performing cold rolling on a seamless pipe as a mother pipe, it is possible to inhibit the generation of metal chips from the end portions of the mother pipe, and to prevent the formation of indentations therein that may be caused by the metal chips to thereby provide good surface appearance. This is made possible by using a mother pipe (1) having end portions at the cold rolling starting side and finishing side that have been R-chamfered, at each outer edge and at each inner edge, such that (T0−T1)/2≤R≤T0/2 is satisfied, where R is a radius (mm) of the R-chamfer on the outer edges and the inner edges of the end portions, T0 is a wall thickness of the mother pipe, and T1 is a wall thickness of the pipe after cold rolling.

1 Claim, 2 Drawing Sheets

METHOD OF COLD ROLLING A SEAMLESS PIPE

TECHNICAL FIELD

The present invention relates to a method of performing cold rolling on a seamless pipe as a mother pipe. More particularly, the present invention relates to a method of cold rolling a seamless pipe capable of inhibiting the generation of metal chips from end portions of the mother pipe when it is cold rolled, and thereby preventing the formation of indentations therein that may be caused by the metal chips and providing good surface appearance.

Unless otherwise specified, the definitions of certain terms used in this specification are as follows.

"Reduction of area": an index that is used to evaluate the degree of reduction in a cold rolling process. The reduction of area Rd (%) can be calculated by the following equation (2) based on the cross sectional area S1 ($mm^2$) of a mother pipe and the cross sectional area S2 ($mm^2$) of the pipe after cold rolling:

$$Rd=(1-S2/S1)\times 100 \quad (2).$$

"Chamfering": Round chamfering by which a surface to be chamfered is rounded is referred to as "R-chamfering". Chamfering by which a surface to be chamfered is made to be flat is simply referred to as "chamfering". Among types of "chamfering", chamfering by which the chamfered surface and the end surface of the mother pipe form an angle of 45 degrees is particularly referred to as "C-chamfering".

BACKGROUND ART

As cold working methods for metal pipes, cold drawing processes using a draw bench and cold rolling processes using a Pilger mill are widely used. In cold drawing processes using a draw bench, a plug, a floating plug, or a mandrel is inserted into a mother pipe, and the mother pipe is drawn through a die to be finished into a product having a desired size.

In such cold drawing processes, it is difficult to perform cold drawing while achieving a high degree of reduction with the reduction of area being set to a high level and therefore there are difficulties in employing a cold drawing process in cold working of small diameter pipes.

On the other hand, with cold rolling processes using a Pilger mill, a high degree of reduction can be achieved in cold working of mother pipes with the reduction of area being set to a high level as compared to cold drawing processes. Because of this, in the manufacturing of seamless pipes, for which a high degree of reduction is required, a cold rolling process using a Pilger mill (Pilger rolling) is typically employed.

In a cold rolling process using Pilger rolling, a pair of vertically arranged grooved rolls, each having a groove in its circumferential surface, is used. Between the grooved rolls is provided a tapered mandrel having a diameter decreasing toward its end. The grooved rolls are supported on a rolling stand via a rotating shaft provided at their centers.

When cold rolling is performed on a mother pipe by Pilger rolling, grooved rolls supported on a rolling stand reciprocate along a mandrel and thereby roll the mother pipe which is a pipe to be processed while reciprocating and rotating. The mother pipe is advanced by a predetermined length and rotated by a predetermined angle during the process of the reciprocating and rotating of the grooved rolls, and is accordingly processed by being gradually reduced in diameter and wall thickness. In this process, the mother pipe that is cold rolled is elongated according to the elongation rate and the feed rate and rolled into a product having a desired size.

When a plurality of mother pipes are cold rolled successively by Pilger rolling, the mother pipes are fed to the Pilger mill in such a manner that the end surface, at the rolling finishing side, of a mother pipe that is cold rolled and the end surface, at the rolling starting side, of a subsequent mother pipe are abutted to each other. Thus, with the feeding of the subsequent mother pipe, the end surface at the rolling starting side of the subsequent mother pipe pushes the end surface at the rolling finishing side of the mother pipe that is cold rolled, and thereby the mother pipe that is cold rolled is advanced.

In the process of such cold rolling by Pilger rolling, the end surface at the rolling finishing side of the mother pipe that is cold rolled and the end surface at the rolling starting side of the subsequent mother pipe are rubbed against each other and some portions thereof are chipped, so that thin metal chips are generated. The metal chips generally have a crescent shape with a length of about 3 mm, a width of about 1 mm and a thickness of about 0.5 mm. When such metal chips are crushed in a subsequent process and adhered to the outer surface or the inner surface of the mother pipe, and then reach the position of the processing by the plug and grooved rolls, the metal chips are pressed into the outer surface or the inner surface of the mother pipe. As a result, indentations are formed in the outer surface or the inner surface of the cold rolled mother pipe. The indentations generally have a circular shape with a diameter of about 1 mm, and their depth is about 0.3 mm at the deepest point. Hereinafter, the "outer surface of the pipe" and the "inner surface of the pipe" are also collectively referred to simply as the "surface of the pipe".

Cold rolled pipes are used, for example, as clean pipes for semiconductor manufacturing equipment and heat exchanger tubes for nuclear power plants. For clean pipes and heat exchanger tubes for nuclear power plants, stringent control of their surface properties is required. If indentations are formed in the surface of the pipe, the indentations may be eliminated by hand work or the portion where the indentations were formed may be cut in a subsequent process depending on the shapes, depths and sizes of the indentations, and these cases may result in a defective finished product. Consequently, the efficiency in manufacturing pipes and the product yield decrease.

In order to inhibit the generation of metal chips, one approach that may be considered is to lower the degree of reduction per pass of cold rolling and increase the number of cold rolling operations to thereby ensure a predetermined degree of reduction. However, this approach significantly deteriorates the manufacturing efficiency because the number of cold rolling operations is increased and also the number of softening heat treatments to be applied to mother pipes is increased. Thus, it is not practical to ensure a predetermined degree of reduction using the approach of lowering the degree of reduction per pass of cold rolling and increasing the number of cold rolling operations.

With regard to methods of cold rolling pipes, there are various conventional proposals as disclosed in Patent Literatures 1 and 2, for example. According to the cold rolling method disclosed in Patent Literature 1, when performing cold rolling on a seamless pipe as a mother pipe, the method uses a mother pipe configured such that: variations in the wall thickness at the inner surface of the end portion at the rolling starting side are defined by a development angle b (rad) and a wall thickness difference d (mm) and the maximum value of its ratio d/b is controlled. Also, it is stated that, when the maximum value of d/b exceeds the control range, the inner edge of the end portion at the rolling starting side is chamfered so that the maximum value of d/b is controlled. It is stated that this inhibits the occurrence of cracking at the pipe end that may be caused by internal polygonization when cold rolling is performed.

However, when cold rolling is performed on a seamless pipe as a mother pipe, metal chips are generated from pipe ends even in the case where internal polygonization has not occurred. Thus, with the cold rolling method disclosed in Patent Literature 1, it is difficult to inhibit the generation of metal chips when cold rolling is performed.

Patent Literature 2 discloses a method of cold rolling a clad steel mother pipe formed of base metal and clad metal. The cold rolling method disclosed in Patent Literature 2 uses a clad steel mother pipe with its end portion at the base metal side chamfered such that a predetermined conditional expression is satisfied. It is stated that this prevents the base metal from protruding at the end portion due to the difference in deformation resistance between the base metal and the clad metal so that separation between the base metal and the clad metal does not occur at the end portion. As described above, in Patent Literature 2, the cold rolling method is directed to clad steel mother pipes, and therefore no studies have been made on the generation of metal chips when cold rolling is performed on a seamless pipe as a mother pipe.

CITATION LIST

Patent Literature

Patent Literature 1: Japanese Patent Application Publication No. 2009-6384

Patent Literature 2: Japanese Patent Application Publication No. 2006-346726

SUMMARY OF INVENTION

Technical Problem

As described above, performing cold working on a mother pipe by a cold drawing process results in a decrease in the degree of reduction, and therefore there are difficulties in applying it to small diameter pipes. Instead, when cold working by cold rolling is applied to a mother pipe, metal chips generated from an end portion of the mother pipe causes the formation of indentations in the outer surface and the inner surface of the pipe, and this poses a problem. The conventional methods for cold rolling pipes address the problem of cracking at pipe ends or separation between base metal and clad metal, but no studies have been made on the generation of metal chips.

The present invention has been made in view of the above circumstances. Accordingly, it is an object of the present invention to provide a method of cold rolling a seamless pipe capable of inhibiting the generation of metal chips from end portions of a mother pipe when it is cold rolled, and thereby preventing the formation of indentations therein that may be caused by the metal chips and providing good surface appearance.

Solution to Problem

In order to solve the above-described problems, the present inventor carried out a variety of experiments and conducted intensive studies, and consequently he has made the following findings. By performing cold rolling using a mother pipe with its end portions R-chamfered, it is possible to inhibit the generation of metal chips from the end portions of the mother pipe.

FIG. 1 is a view of an end portion of a mother pipe with the end portion having been R-chamfered. The mother pipe 1 shown in FIG. 1 has been R-chamfered at its end portions, at each outer edge and each inner edge, and the radius R of the R-chamfer on the outer edge and the radius R of the R-chamfer on the inner edge are the same value. The radius R of the R-chamfer on the outer edge and the radius R of the R-chamfer on the inner edge may be the same value or different values from each other. The present inventor has found that the generation of metal chips from the end portions of the mother pipe can be inhibited by applying the above-described R-chamfering to the end portions of a mother pipe both at the cold rolling starting side and at the finishing side. In order to determine the shape of the end portion that is capable of inhibiting the generation of metal chips, a test was conducted in which cold rolling was performed on mother pipes with varied radii R (mm) of the R-chamfer, as shown in the later-described examples.

FIG. 2, which will be referred to in the later-described Example, is a graph showing the relationship between the radius R (mm) of the R-chamfer and (T0−T1)/2 (mm) where T0 is a wall thickness (mm) of the mother pipe and T1 is a wall thickness of the pipe after cold rolling. In FIG. 2, the outlined circles and squares indicate the case in which metal chips were not generated, and the black circles and squares indicate the case in which metal chips were generated, when cold rolling was performed. From FIG. 2, it has become clear that, in order to inhibit the generation of metal chips, the radius R of the R-chamfer must satisfy the condition, (T0−T1)/2≤R.

FIG. 3, which will be referred to in the later-described Example, is a graph showing the relationship between the radius R (mm) of the R-chamfer and T0/2 (mm) where T0 is a wall thickness (mm) of the mother pipe. In FIG. 3, the black circles and squares indicate the case in which metal chips were generated, and the outlined circles and squares indicate the case in which metal chips were not generated, when cold rolling was performed. From FIG. 3, it has become clear that, in order to inhibit the generation of metal chips, the radius R of the R-chamfer must satisfy the condition, R≤T0/2.

From the above findings, it has become clear that the generation of metal chips can be inhibited when the radius R of the R-chamfer on the end portions of a mother pipe satisfies the condition, (T0−T1)/2≤R≤T0/2.

The present invention has been accomplished based on the above findings, and the summary thereof is a method of cold rolling a seamless pipe as set forth below.

A method of cold rolling a seamless pipe, including cold rolling a seamless pipe as a mother pipe, the method comprising: using a mother pipe having end portions at a cold rolling starting side and at a cold rolling finishing side, the end portions being R-chamfered at outer edges thereof and inner edges thereof such that the following formula (1) is satisfied.

$$(T0-T1)/2 \leq R \leq T0/2 \quad (1)$$

where R is a radius (mm) of the R-chamfer on the outer edges and the inner edges of the end portions, T0 is a wall thickness of the mother pipe, and T1 is a wall thickness of the pipe after cold rolling.

Advantageous Effects of Invention

The method of cold rolling a seamless pipe of the present invention has the following advantageous effects:

(1) The method of cold rolling a seamless pipe of the present invention uses a mother pipe with its end portions R-chamfered such that the formula (1) is satisfied, when cold rolling is performed.

(2) The above (1) makes it possible to inhibit the generation of metal chips from the end portions of the mother pipe.

(3) The above (2) makes it possible to prevent the formation of indentations that may be caused by the metal chips and thus to provide the resulting pipe with good surface appearance.

DESCRIPTION OF EMBODIMENTS

As described above, the method of cold rolling a seamless pipe of the present invention uses a mother pipe having end portions at a cold rolling starting side and at a cold rolling finishing side, the end portions being R-chamfered at outer edges thereof and inner edges thereof such that the following formula (1) is satisfied.

$$(T0-T1)/2 \leq R \leq T0/2 \quad (1)$$

where R is a radius (mm) of the R-chamfer on the outer edges and the inner edges of the end portions, T0 is a wall thickness of the mother pipe, and T1 is a wall thickness of the pipe after cold rolling.

The following are descriptions of the reasons for configuring the method of cold rolling a seamless pipe of the present invention as set forth above.

The present invention is concerned with seamless pipes. The reason for this is that seamless pipes are used as mother pipes in the manufacture of special purpose metal pipes, for which good surface appearance is required with no formation of indentations that may be caused by metal chips, such as clean pipes for semiconductor manufacturing equipment and heat exchanger tubes for nuclear power plants.

Figure 1:
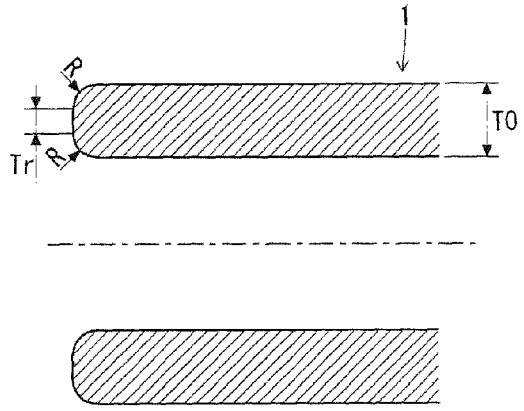
FIG. 1 is a view of an end portion of a mother pipe with the end portion having been R-chamfered.

In the method of cold rolling a seamless pipe of the present invention, the outer edge and the inner edge of the end portions are R-chamfered as shown in FIG. 1. The R-chamfering that is applied to the outer edge and the inner edge is applied to both end portions at the cold rolling starting side and at the cold rolling finishing side. The purpose of applying R-chamfering as described above is to form the vicinity of the intersection between the outer surface and the end surface and the intersection between the inner surface and the end surface into a blunt shape because, if the vicinities of the intersections have an angular shape, the areas are chipped so that metal chips are generated.

In place of R-chamfering, applying chamfering such as C-chamfering to the outer edges and the inner edges of the end portions may be considered. However, chamfering results in forming an intersection between the outer surface and the chamfered surface, an intersection between the inner surface and the chamfered surface, and intersections between the end surface and the chamfered surfaces. The vicinities of the intersections have an angular shape, and therefore the areas are chipped so that metal chips are generated. For this reason, chamfering is not suitable, and thus R-chamfering is employed in the method of cold rolling a seamless pipe of the present invention.

Figure 2:
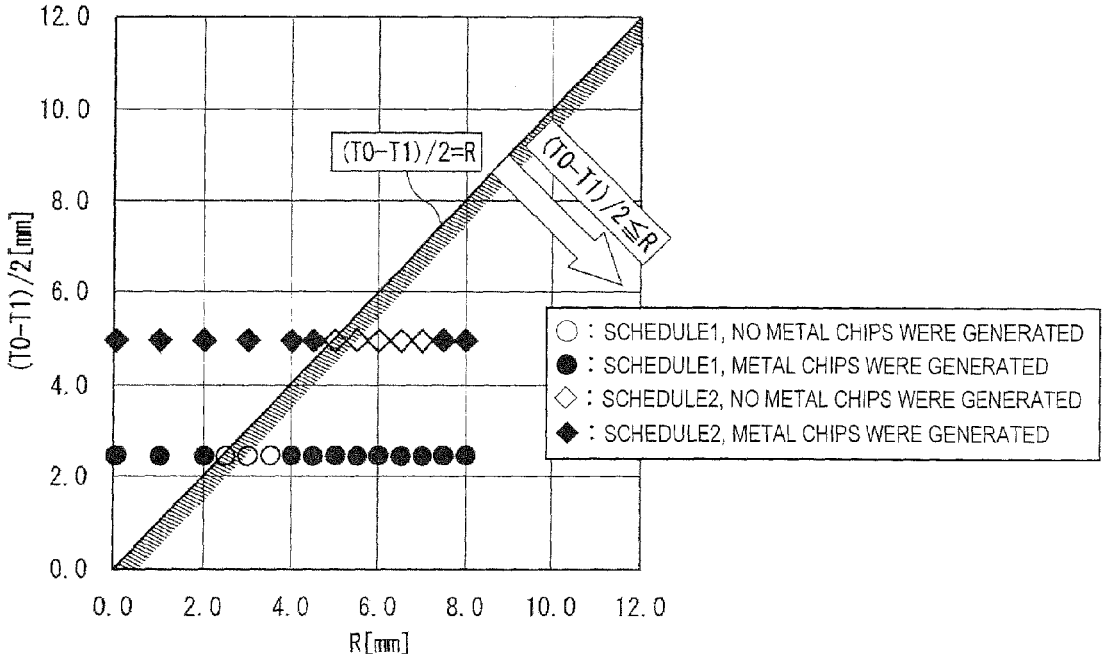
FIG. 2 is a graph showing the relationship between the radius R (mm) of the R-chamfer and (T0−T1)/2 (mm) where T0 is a wall thickness (mm) of the mother pipe and T1 is a wall thickness of the pipe after cold rolling.
Figure 3:
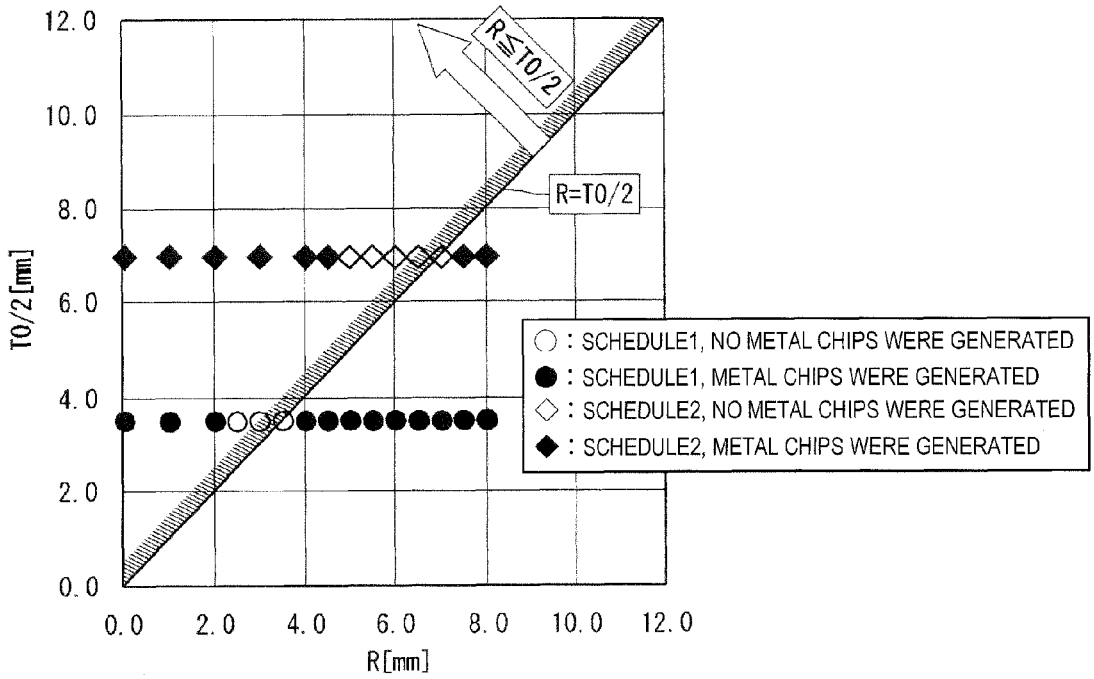
FIG. 3 is a graph showing the relationship between the radius R (mm) of the R-chamfer and T0/2 (mm) where T0 is a wall thickness (mm) of the mother pipe.

The method of cold rolling a seamless pipe of the present invention uses a mother pipe to which R-chamfering has been applied such that the radius R satisfies the formula (1). This makes it possible to inhibit the generation of metal chips from end portions of the mother pipe when it is cold rolled as shown in FIGS. 2 and 3 as described later. By virtue of this, it is possible to prevent indentations that may be caused by metal chips from being formed in the surface of the pipe, and thus to provide the resulting pipe with good surface appearance. Consequently, the work of eliminating indentations by hand work, which is necessitated by the indentations, becomes unnecessary, and therefore the manufacturing efficiency is increased. Moreover, cutting which is necessitated by indentations becomes unnecessary and reduction of defective finished products is possible, which results in an increase in the manufacturing yield.

If the radius R of the R-chamfering is greater than T0/2, exceeding the range specified by the formula (1), the length Tr of the end surface of the mother pipe shown in FIG. 1 becomes zero, and thus the R-chamfered surface on the outer edge and the R-chamfered surface on the inner edge become continuous with each other. In this case, the vicinity of the intersection between the R-chamfered surface on the outer edge and the R-chamfered surface on the inner edge is angularly shaped. If a mother pipe having such an end shape is subjected to cold rolling, the angular portion in the vicinity of the intersection between the R-chamfered surfaces is chipped so that metal chips are generated.

In the meantime, the lower limit for the radius R is specified by (T0−T1)/2≤R. Herein, when T0 is expressed using the length Tr of the end surface of the mother pipe, T0=Tr+2R is obtained. When this equation is substituted into (T0−T1)/2≤R to modify the formula, then Tr≤T1 is obtained. Accordingly, when the radius R is smaller than (T0−T1)/2, it means that the length Tr of the end surface of the mother pipe is greater than the wall thickness T1 after cold rolling. When the length Tr of the end surface of the mother pipe is greater than the wall thickness T1 after cold rolling, metal chips are generated during the cold rolling operation. The reasons for the generation of metal chips in this case are not clear, but it is estimated that the generation of metal chips is due to partial peeling of the end surface of the mother pipe which may be caused by strong pressing against the end portion of the mother pipe applied by the grooved rolls and the mandrel during the cold rolling operation.

The method of cold rolling a seamless pipe of the present invention is not limited to the case in which the radius R of the R-chamfering on the outer edge of the mother pipe and the radius R of the R-chamfering on the inner edge thereof are the same values as shown in FIG. 1. That is, the radius R of the R-chamfering on the outer edge of the mother pipe and the radius R of the R-chamfering on the inner edge thereof may be different values as long as they both satisfy the formula (1).

EXAMPLES

To verify the advantages of the method of cold rolling a seamless pipe of the present invention, a test was conducted in which a mother pipe with its end portions R-chamfered was subjected to cold rolling.

[Test Method]

In this test, cold rolling by Pilger rolling was performed using, as mother pipes, seamless pipes prepared by the following procedure.

(1) A hollow billet was hot worked into a seamless pipe by the Ugine-Sejournet process; and (2) The seamless pipe prepared by the hot working was R-chamfered at both end portions, at each outer edge and at each inner edge.

In the R-chamfering mentioned in the above (2), mother pipes having the same radius R of the R-chamfer for the outer edge and the inner edge were prepared, and mother pipes having different radii R of the R-chamfer for the outer edge and the inner edge were prepared.

The mother pipes used in this test were ones made from a Ni-based alloy of ASME SB-163 UNS N06690 having a nominal composition of 30 mass % Cr-60 mass % Ni-10 mass % Fe. Table 1 shows the processing schedule in this test and the reduction of area calculated by the equation (2).

TABLE 1

| | Mother pipe before rolling | | Pipe after rolling | | |
|---|---|---|---|---|---|
| Processing schedule | Outside diameter (mm) | Wall thickness (mm) | Outside diameter (mm) | Wall thickness (mm) | Reduction of Area (%) |
| 1 | 55.0 | 7.0 | 23.0 | 2.0 | 87.5 |
| 2 | 78.0 | 14.0 | 38.0 | 4.0 | 84.8 |

In this test, both end portions of the pipes produced by cold rolling were observed with a magnifying glass at a magnification of 20× to examine for the presence or absence of chipped areas in association with the generation of metal chips. In the examination, it was determined that the generation of metal chips occurred if a chipped area was found; and it was determined that the generation of metal chips did not occur if no chipped area was found.

[Test Results]

FIG. 2 is a graph showing the relationship between the radius R (mm) of the R-chamfer and (T0−T1)/2 (mm) where T0 is a wall thickness (mm) of the mother pipe and T1 is a wall thickness of the pipe after cold rolling.

FIG. 3 is a graph showing the relationship between the radius R (mm) of the R-chamfer and T0/2 (mm) where T0 is a wall thickness (mm) of the mother pipe.

The test results shown in FIGS. 2 and 3 are the results of a test which used the mother pipe having the same radius R of the R-chamfer for the outer edge and the inner edge.

In FIGS. 2 and 3, the results of the test according to the processing schedule 1 are indicated by the circles, among which the outlined circles indicate that the generation of metal chips did not occur, and the black circles indicate that the generation of metal chips occurred. The results of the test according to the processing schedule 2 are indicated by the squares, among which the outlined squares indicate that the generation of metal chips did not occur, and the black squares indicate that the generation of metal chips occurred.

FIG. 2 demonstrates that, by setting the radius R of the R-chamfer so as to satisfy the condition, R≥(T0−T1)/2, it is possible to inhibit the generation of metal chips. Furthermore, FIG. 3 demonstrates that, by setting the radius R of the R-chamfer so as to satisfy the condition, R≤T0/2, it is possible to inhibit the generation of metal chips. These results demonstrate that the method of cold rolling a seamless pipe of the present invention is capable of inhibiting the generation of metal chips.

Now, a description is given as to a test which used the mother pipe having different radii R of the R-chamfer for the outer edge and the inner edge. Regarding the test, table 2 shows the classification, the processing schedule, the radius R of the R-chamfer on the outer edge and the inner edge, and whether or not metal chips were generated. The symbol "*" in the section of the radius R of the R-chamfer on the outer edge and the inner edge means that the radius R does not satisfy the formula (1).

TABLE 2

| | | Radius R of R-chamfer (mm) | | Generation |
|---|---|---|---|---|
| Classification | Processing schedule | Outer edge | Inner edge | of metal chips |
| Comparative Example | 1 | 1.0* | 0.5* | Yes |
| Inventive Example | | 2.5 | 3.5 | No |
| Inventive Example | | 3.5 | 2.5 | No |
| Comparative Example | | 5.0* | 3.5 | Yes |
| Comparative Example | 2 | 3.5* | 2.5* | Yes |
| Inventive Example | | 5.0 | 7.0 | No |
| Inventive Example | | 7.0 | 5.0 | No |
| Comparative Example | | 10.0* | 7.0 | Yes |

Table 2 shows that the generation of metal chips was inhibited also when the radius R of the R-chamfer on the outer edge and the radius R of the R-chamfer on the inner edge were different values, by setting both radii R so as to satisfy the formula (1). These results confirm that the radius R of the R-chamfering on the outer edge of the mother pipe and the radius R of the R-chamfering on the inner edge thereof may be different values as long as they both satisfy the formula (1).

INDUSTRIAL APPLICABILITY

The method of cold rolling a seamless pipe of the present invention is capable of inhibiting the generation of metal chips from end portions of a mother pipe when it is cold rolled, and thereby preventing the formation of indentations therein that may be caused by the metal chips and thus producing pipes having good surface appearance. When such method of cold rolling a seamless pipe of the present invention is applied to the manufacturing of seamless pipes that are used as clean pipes or heat exchanger tubes for nuclear power plants, it will greatly contribute to the improvement in the manufacturing efficiency and yield for the seamless pipes.

REFERENCE SIGNS LIST

1: mother pipe, R: radius of R-chamfer,

T0: wall thickness of mother pipe, Tr: length of end surface of mother pipe.

What is claimed is:

1. A method of cold rolling a seamless pipe, including cold rolling a seamless pipe as a mother pipe using a Pilger mill, the method comprising:

using a mother pipe having end portions at a cold rolling starting side and at a cold rolling finishing side, the end portions being R-chamfered at outer edges thereof and inner edges thereof such that the following formula (1) is satisfied:

$$(T0-T1)/2 \leq R \leq T0/2 \quad (1)$$

where R is a radius (mm) of the R-chamfer on the outer edges and the inner edges of the end portions, T0 is a wall thickness (mm) of the mother pipe, and T1 is a wall thickness (mm) of the pipe after cold rolling.

* * * * *